US012716259B2

(12) United States Patent
Shen

(10) Patent No.: US 12,716,259 B2
(45) Date of Patent: Aug. 25, 2026

(54) TENT SKELETON WITH SUPPORTING AND LIMITING STRUCTURE

(71) Applicant: Ningbo Kingwell Leisure Products Co. Ltd., NingBo (CN)

(72) Inventor: Zilyu Shen, NingBo (CN)

( * ) Notice: Subject to any disclaimer, the term of this patent is extended or adjusted under 35 U.S.C. 154(b) by 130 days.

(21) Appl. No.: 18/776,237

(22) Filed: Jul. 17, 2024

(65) Prior Publication Data

US 2026/0022582 A1 Jan. 22, 2026

(51) Int. Cl.
*E04H 15/10* (2006.01)
*E04H 15/50* (2006.01)
*E04H 15/60* (2006.01)

(52) U.S. Cl.
CPC ..... *E04H 15/10* (2013.01); *E04H 15/50* (2013.01); *E04H 15/60* (2013.01)

(58) Field of Classification Search
CPC ..... E04H 15/10
USPC ..... 135/91, 910
See application file for complete search history.

(56) References Cited

U.S. PATENT DOCUMENTS 2,087,537 A * 7/1937 Finkel ..... A45B 3/04 135/910
5,584,564 A * 12/1996 Phyle ..... F21V 33/006 135/910
7,703,466 B1 * 4/2010 Smith ..... E04H 15/10 362/396
10,233,664 B2 * 3/2019 Choi ..... E04H 15/10
10,458,145 B2 * 10/2019 Cantwell ..... E04H 15/44
11,959,299 B2 * 4/2024 Choi ..... E04H 15/10
2006/0272686 A1 * 12/2006 Tung ..... A45B 3/04 135/16
2007/0151588 A1 * 7/2007 Yul ..... E04H 15/50 135/135
2008/0000513 A1 * 1/2008 Yul ..... H02S 10/40 136/244
2019/0338550 A1 * 11/2019 Zhu ..... F21V 33/006
2020/0157838 A1 * 5/2020 Yuan ..... E04H 15/50

* cited by examiner

*Primary Examiner* — Robert Canfield
(74) *Attorney, Agent, or Firm* — Sandy Lipkin

(57) ABSTRACT

The present invention discloses a tent skeleton with a supporting and limiting structure, including a main hinge seat and an auxiliary hinge seat. A light stick is magnetically connected between the main hinge seat and the auxiliary hinge seat, four top rods are hinged to a middle part of an outer side of the main hinge seat; one end, away from the main hinge seat, of each of the four top rods is hinged to a connecting rod; one end, away from the top rod, of each of the four top rods is hinged to an upper connecting seat; bottoms of the four upper connecting seats are fixedly connected to supporting rods; each of the four supporting rods is slidably connected to a lower connecting seat; and each of the four lower connecting seats is hinged to a top cross rod.

7 Claims, 7 Drawing Sheets

TENT SKELETON WITH SUPPORTING AND LIMITING STRUCTURE

TECHNICAL FIELD

The present invention relates to the field of tents, and in particular to a tent skeleton with a supporting and limiting structure.

BACKGROUND

A tent is a shed erected on the ground to provide temporary shelter from wind, rains and sunlight. It is mostly made of canvas and can be dismantled and moved at any time together with supporting materials. The tent is carried in a form of parts and assembled after a person arrives at a site, so various parts and tools are required. An existing tent technology generally uses a skeleton structure for supporting and construction. A tent skeleton needs to have relatively reliable supporting force without being easily destroyed by external forces.

An existing tent skeleton uses a main bracket to put up the entire tent as a whole, but the main bracket lacks a limit during supporting; and then, when gravity of a top of the tent is large, it will cause severely downward press on a main frame and shrinkage of a side supporting rod, so that supporting stability needs to be improved. The tent is often inconvenient in lighting at night, so it is necessary to carry a lighting lamp.

SUMMARY

The purpose of the present invention is to provide a tent skeleton with a supporting and limiting structure, aiming to solve the problems raised in the Background.

To achieve the above-mentioned purpose, the present invention provides the following technical solutions: a tent skeleton with a supporting and limiting structure includes a main hinge seat and an auxiliary hinge seat. A light stick is magnetically connected between the main hinge seat and the auxiliary hinge seat; four top rods are hinged to a middle part of an outer side of the main hinge seat; one end, away from the main hinge seat, of each of the four top rods is hinged to a connecting rod; one end, away from the top rod, of each of the four top rods is hinged to an upper connecting seat; bottoms of the four upper connecting seats are fixedly connected to supporting rods; each of the four supporting rods is slidably connected to a lower connecting seat; and each of the four lower connecting seats is hinged to a top cross rod; one ends, away from the lower connecting seats, of the four top cross rods are hinged to middle parts of the four connecting rods respectively; a middle part of an outer side of the auxiliary hinge seat is hinged to four limiting supporting rods; and one ends, away from the auxiliary hinge seat of the four limiting supporting rods are hinged to the middle parts of the four top rods respectively.

As a preferred technical solution of the present invention, both ends of the light stick are fixedly connected to the ends; a surface of the end at the lower end is provided with a switch and a charging interface; a battery and a rectifier controller are fixedly installed inside the end at the lower end; the switch and the charging interface are arranged on both sides of the surface of the end at the lower end; and the battery and the rectifier controller are installed inside the end at the lower end.

As a preferred technical solution of the present invention, the charging interface is electrically connected to the battery through the rectifier controller; the battery is electrically connected to the light stick through the switch; a power cord is connected to the charging interface; and the battery is charged through the rectifier controller. The switch is turned on, the battery is powered, and the light stick emits light after being powered on for lighting.

As a preferred technical solution of the present invention, a top of the upper end is fixedly connected with a positioning column which is snap-connected with the main hinge seat; the two ends of the light stick are fixedly connected with strong magnets respectively; and the two strong magnets are magnetically connected to the main hinge seat and the auxiliary hinge seat respectively. The light stick is magnetically adsorbed to the main hinge seat and the auxiliary hinge seat by the strong magnets for magnetically fixation.

As a preferred technical solution of the present invention, connection parts between the four connecting rods and the top rods are fixedly connected to supporting seats respectively for supporting bottoms of the top rods, and the four top rods are fixedly connected to limiting rods for limiting the limiting supporting rods.

As a preferred technical solution of the present invention, a diamond-shaped telescopic frame for improving stability of a bottom of the skeleton is hinged between the upper connecting seat and the lower connecting seat on the supporting rod and the upper connecting seat and the lower connecting seat on the adjacent supporting rod. The diamond-shaped telescopic frame is composed of a plurality of hinged horizontal cross rods hingedly connected, and four diamond-shaped telescopic frames are used for improving stability among the four supporting rods.

As a preferred technical solution of the present invention, a limiting sleeve located between the upper connecting seat and the lower connecting seat is sleeved on each of the four supporting rods; a bottom of each of the four supporting rods is fixedly connected to a fixing seat; the limiting sleeve limits the lower connecting seat; and the supporting rod is fixed to the ground through the fixing seat.

Compared to the prior art, the present invention has the following beneficial effects:

1. During unfolding of the top rod and the connecting rod, the connecting rod pulls the lower connecting seat to move upward along the supporting rod through the top cross rod, and move to the upper connecting seat, driving the four diamond-shaped telescopic frames to extend, so that the tent skeleton can be unfolded. Meanwhile, the four limiting supporting rods hinged to the auxiliary hinge seat can be straightened to consolidate support on the top rod. When the auxiliary hinge seat rises to a certain point, the tent will be very absolutely put up. The stability of the tent frame is improved by the arranged limiting structure.
2. The detachable light stick is arranged between the main hinge seat and the auxiliary hinge seat of the tent skeleton and magnetically fixed by the magnet. The light stick is used for lighting, and can also be taken down and placed on a table for use, or used as a flashlight, which is suitable for use in multiple scenarios.

In the figures: 1. main hinge seat; 2. top rod; 3. light stick; 4. auxiliary hinge seat; 5. limiting supporting rod; 6. connecting rod; 7. supporting rod; 8. diamond-shaped telescopic frame; 9. limiting rod; 10. supporting seat; 11. strong magnet; 12. end; 13. positioning column; 14. charging interface; 15. battery; 16. rectifier controller; 17. top cross rod; 18. upper connecting seat; 19. switch; 20. fixing seat; 21. limiting sleeve; and 22. lower connecting seat.

DETAILED DESCRIPTION OF EMBODIMENTS

The following clearly and completely describe the technical solutions in embodiments of the present invention in conjunction with the accompanying drawings in the embodiments of the present invention. Obviously, the described embodiments are only a part of the embodiments of the present invention, rather than all embodiments. Based on the embodiments of the present invention, all other embodiments obtained by a person skilled in the art without creative labor shall fall within the scope of protection of the present invention.

Figure 1:
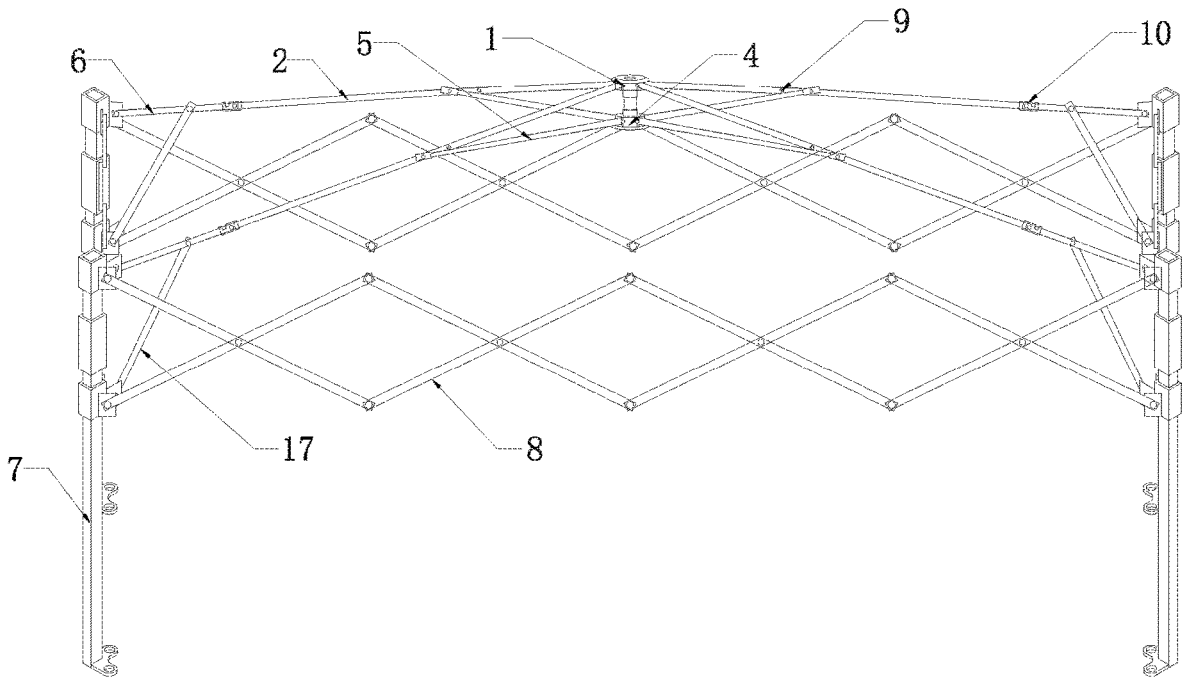
FIG. 1 is a structural schematic diagram of the present invention.
Figure 2:
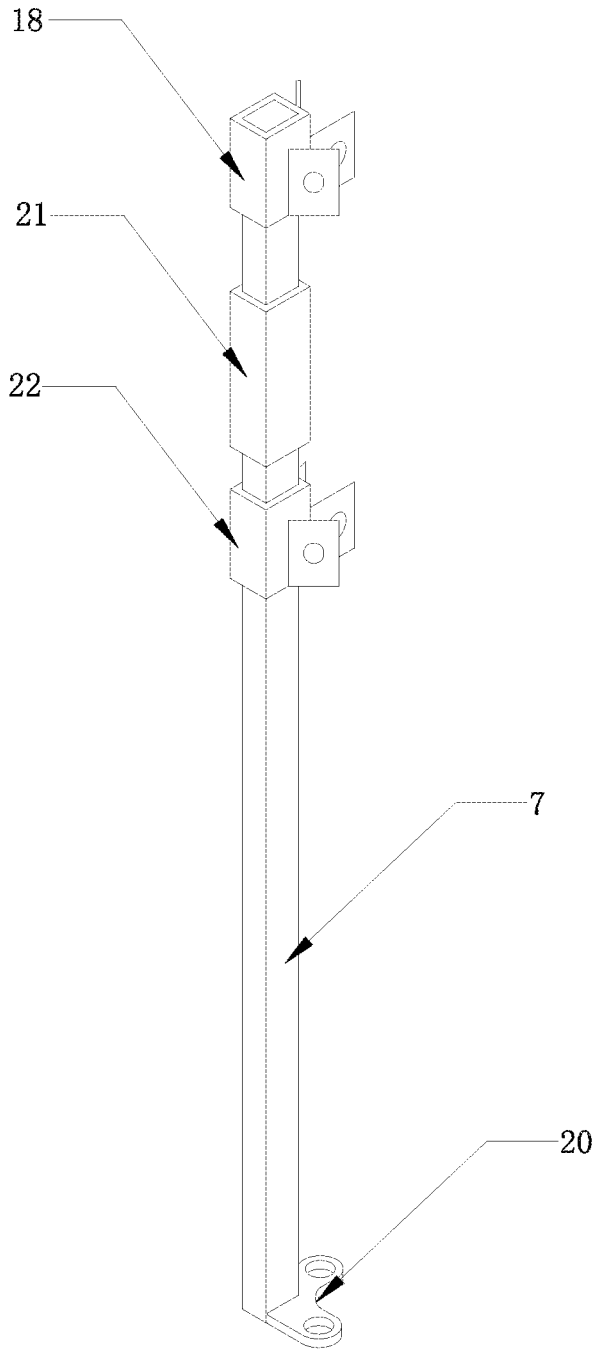
FIG. 2 is a structural schematic diagram of a supporting rod of the present invention.
Figure 3:
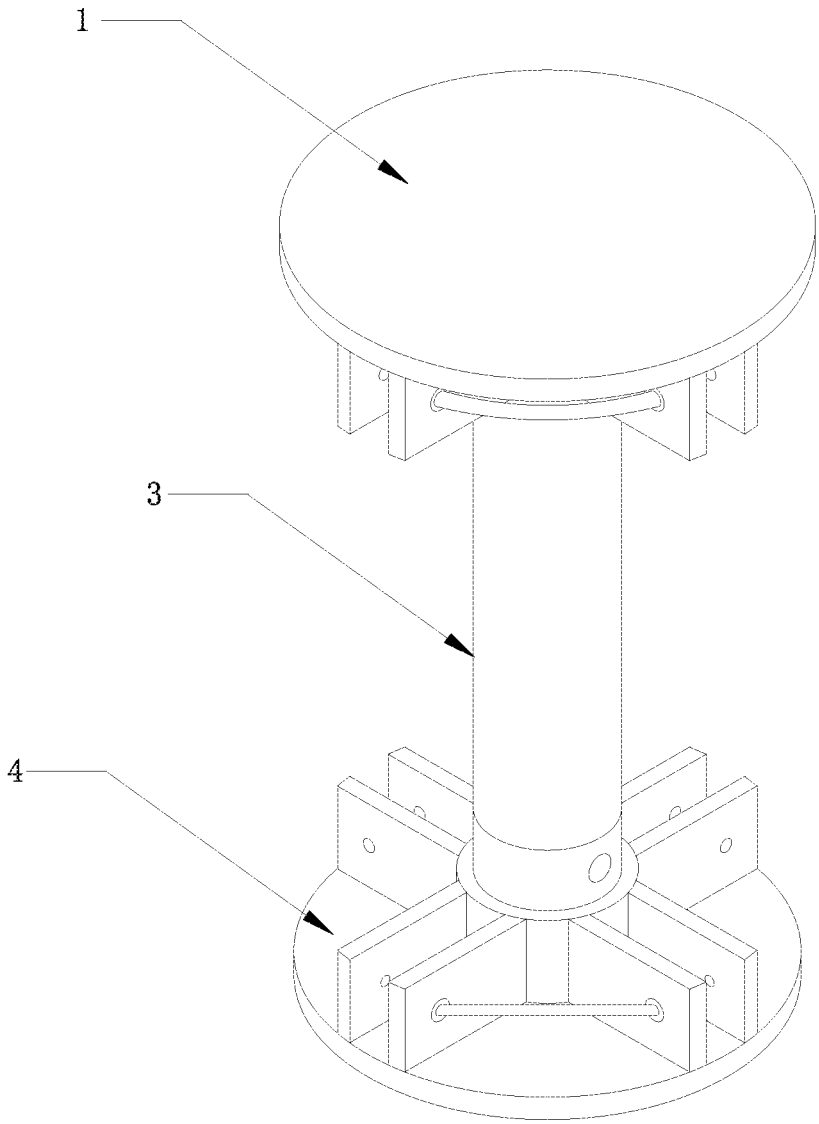
FIG. 3 is a structural schematic diagram of a main hinge seat, a light stick, and an auxiliary hinge seat of the present invention.
Figure 4:
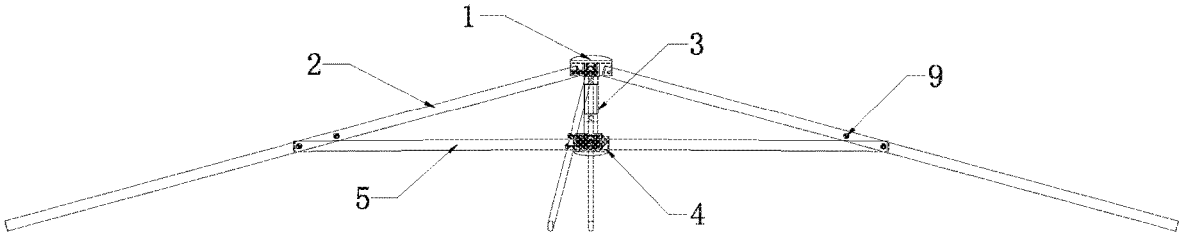
FIG. 4 is a schematic diagram of a partial structure of the present invention.
Figure 5:
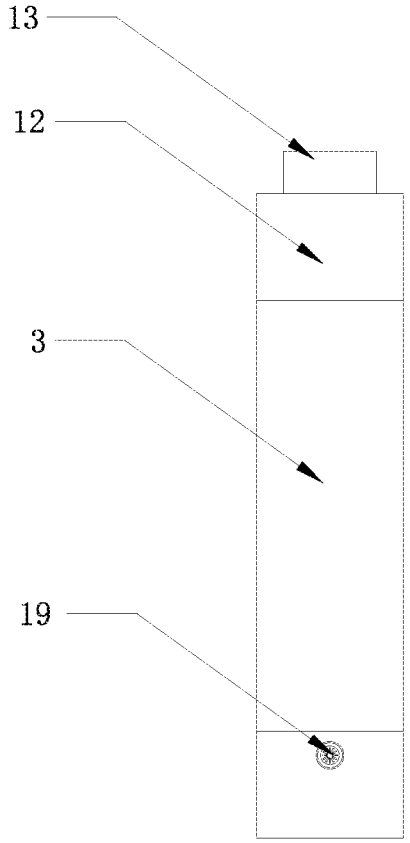
FIG. 5 is a first side view of a light stick of the present invention.
Figure 6:
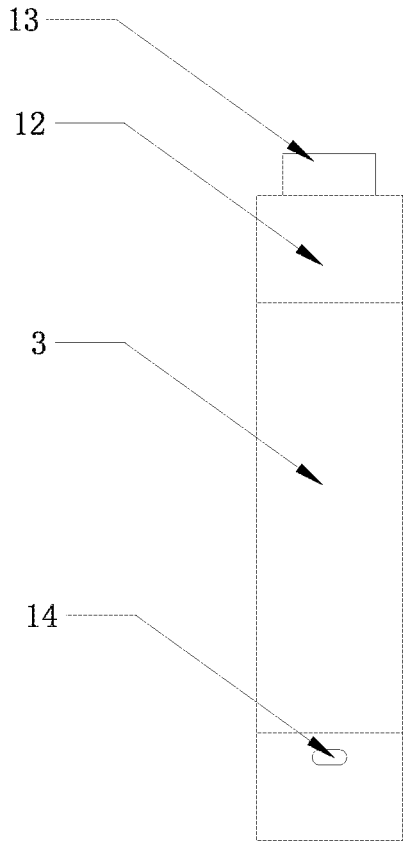
FIG. 6 is a second side view of a light stick of the present invention.
Figure 7:
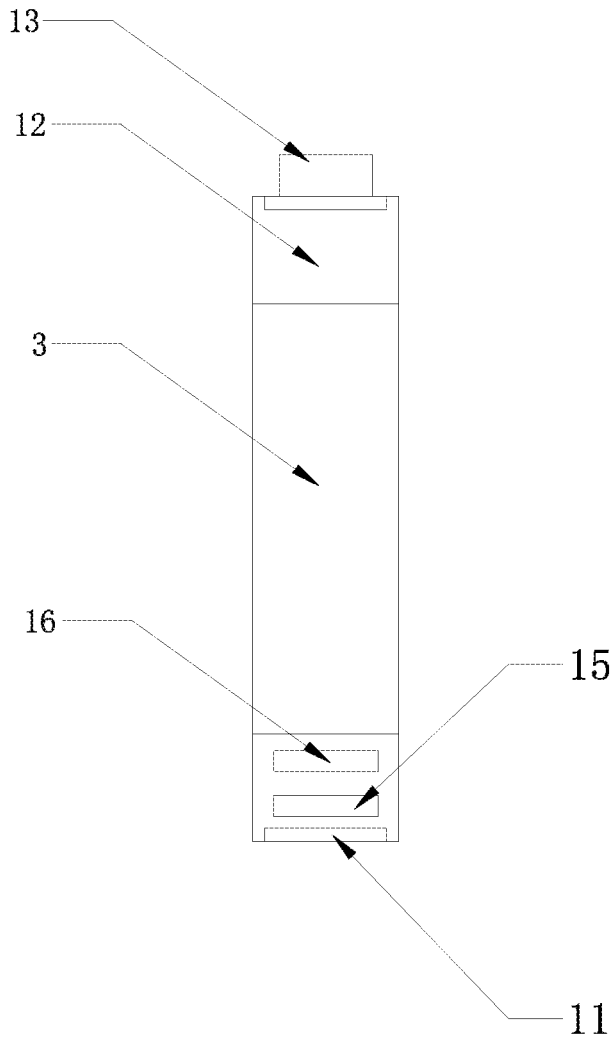
FIG. 7 is a cross-sectional view of the light stick of the present invention.

Referring to FIGS. 1-7, the present invention provides a tent skeleton with a supporting and limiting structure, including a main hinge seat 1 and an auxiliary hinge seat 4; a light stick 3 is magnetically connected between the main hinge seat 1 and the auxiliary hinge seat 4; both ends of the light stick 3 are fixedly connected with ends 12 respectively; a switch 19 and a charging interface 14 are installed on the surface of the end 12 at the lower end; a battery 15 and a rectifier controller 16 are fixedly installed inside the end 12 at the lower end; the charging interface 14 is electrically connected to the battery 15 through the rectifier controller 16; the battery 15 is electrically connected to the light stick 3 through the switch 19; a positioning column 13 that is snap-connected to the main hinge seat 1 is fixedly connected to a top of the end 12 of the upper end; and strong magnets 11 are fixedly connected to the two ends 12 of the light stick 3 respectively; and the two strong magnets 11 are magnetically connected to the main hinge seat 1 and the auxiliary hinge seat 4 respectively;

When in use, a charging line connected to a power source is plugged into the charging interface 14, and the battery 15 is charged after rectification by the rectifier controller 16. The switch 19 is turned on; the battery 15 powered; and the light stick 3 emits light after being powered on for lighting.

Four top rods 2 are hinge to a middle part of an outer side of the main hinge seat 1; one end, away from the main hinge seat 1, of each of the four top rods 2 is hinged to a connecting rod 6; one end, away from the top rod 2, of each of the four connecting rods 6 is hinged to an upper connecting seat 18; a bottom of each of the four upper connecting seats 18 is fixedly connected to a supporting rod 7; each of the four supporting rods 7 is slidably connected to a lower connecting seat 22; each of the four lower connecting seats 22 is hinged to a top cross rod 17; one ends, away from the lower connecting seats 22, of the four top cross rods 17 are hinged to middle parts of the four connecting rods 6 respectively; a middle part of an outer side of the auxiliary hinge seat 4 is hinged to four limiting supporting rods 5; and one ends, away from the auxiliary hinge seat 4 of the four limiting supporting rods 5 are hinged to the middle parts of the four top rods 2 respectively.

When in use, the main hinge seat 1, the auxiliary hinge seat 4, the four top rods 2, the four limiting supporting rods 5, the four connecting rods 6, the four supporting rods 7, and the four top cross rods 17 form the tent skeleton.

Connection parts between the four connecting rods 6 and the top rods 2 are fixedly connected to a supporting seat 10 for supporting bottoms of the top rods 2, and each of the four top rods 2 is fixedly connected to a limiting rod 9 for limiting the limiting supporting rod 5.

When in use, after the connecting rod 6 and the top rod 2 are unfolded into a straight state, the supporting seat 10 supports the top rod 2, and the limiting rod 9 limits the limiting supporting rod 5.

A diamond-shaped telescopic frame 8 for improving stability of a bottom of the skeleton is hinged between the upper connecting seat 18 and the lower connecting seat 22 on the supporting rod 7 and the upper connecting seat 18 and the lower connecting seat 22 on the adjacent supporting rod 7; and the diamond-shaped telescopic frame 8 is composed of a plurality of horizontal cross rods hingedly connected.

When in use, the diamond-shaped telescopic frame 8 is composed of the plurality of horizontal cross rods hingedly connected, and the four diamond-shaped telescopic frames 8 are used for improving the stability between the four supporting rods 7.

A limiting sleeve 21 located between the upper connecting seat 18 and the lower connecting seat 22 is sleeved on each of the four supporting rods 7, and the bottom of each of the four supporting rods 7 is fixedly connected to a fixing seat 20.

When in use, the limiting sleeve 21 limits the lower connecting seat 22, and the supporting rod 7 is fixed to the ground through the fixing seat 20.

When in specific use of the tent skeleton with the supporting and limiting structure of the present invention, when the whole frame is put up during use, the main hinge seat 1 is pulled up to unfold the top rod 2 and the connecting rod 6; the connecting rod 6 pulls the lower connecting seat 22 to move upward along the supporting rod 7 through the top cross rod 17, and move to the upper connecting seat 18, driving the four diamond-shaped telescopic frames 8 to extend, so that the tent frame is unfolded. After the main hinge seat 1 unfolds the four top rods 2, it pushes up the auxiliary hinge seat 4; and meanwhile, the four limiting supporting rods 5 hinged to the auxiliary hinge seat 4 can be straightened to consolidate the support on the top rod 2. When the auxiliary hinge seat 4 rises to a certain point, the tent will be very absolutely put up. After the auxiliary hinge seat 4 exceeds this point, the top rod 2 applies counter-acting force to the auxiliary hinge seat 4 through the limiting supporting rod 5, and applies upward force to the auxiliary hinge seat 4 until the auxiliary hinge seat 4 hits the light stick 3, and limiting is performed by the limiting supporting rod 5, the limiting rod 9, and the supporting seat 10, thereby improving the stability of the tent skeleton.

The light stick 3 is snap-connected to the bottom of the main hinge seat 1 through the positioning column 13. After the auxiliary hinge seat 4 is pushed up, the auxiliary hinge seat 4 rests against the bottom of the light stick 3. The main hinge seat 1 and the auxiliary hinge seat 4 are in contact with the light stick 3 through the strong magnet 11 for magnetic fixation. A charging line connected to a power source is plugged into the charging interface 14, and the battery 15 is charged after rectification by the rectifier controller 16. The switch 19 is turned on; the battery 15 powered; and the light stick 3 emits light after being powered on for lighting. The light stick 3 can be taken down and placed on a table for use, or used as a flashlight, which is suitable for use in multiple scenarios.

Although the present invention has been described in detail with reference to the aforementioned embodiments, a person skilled in the art may still modify the technical solutions described in the aforementioned embodiments, or make equivalent substitutions for some of the technical features therein. Any modifications, equivalent substitutions, improvements, etc. made within the spirit and principles of the present invention shall be included in the protection scope of the present invention.

What is claimed is:

1. A tent skeleton with a supporting and limiting structure, comprising a main hinge seat (1) and an auxiliary hinge seat (4), characterized in that: a light stick (3) is magnetically connected between the main hinge seat (1) and the auxiliary hinge seat (4); four top rods (2) are hinged to a middle part of an outer side of the main hinge seat (1); one end, away from the main hinge seat (1), of each of the four top rods (2) is hinged to a connecting rod (6); one end, away from the top rod (2), of each of the four connecting rods (6) is hinged to an upper connecting seat (18); a bottom of each of the four upper connecting seats (18) is fixedly connected to a supporting rod (7); each of the four supporting rods (7) is slidably connected to a lower connecting seat (22); each of the four lower connecting seats (22) is hinged to a top cross rod (17); one ends, away from the lower connecting seats (22), of the four top cross rods (17) are hinged to middle parts of the four connecting rods (6) respectively; a middle part of an outer side of the auxiliary hinge seat (4) is hinged to four limiting supporting rods (5); and one ends, away from the auxiliary hinge seat (4) of the four limiting supporting rods (5) are hinged to the middle parts of the four top rods (2) respectively.

2. The tent skeleton with the supporting and limiting structure according to claim 1, wherein both ends of the light stick (3) are fixedly connected to ends (12) respectively; a switch (19) and a charging interface (14) are installed on a surface of the end (12) at the lower end; and a battery (15) and a rectifier controller (16) are fixedly installed inside the end (12) at the lower end.

3. The tent skeleton with the supporting and limiting structure according to claim 2, wherein the charging interface (14) is electrically connected to the battery (15) through the rectifier controller (16), and the battery (15) is electrically connected to the light stick (3) through the switch (19).

4. The tent skeleton with the supporting and limiting structure according to claim 2, wherein a positioning column (13) which is snap-connected to the main hinge seat (1) is fixedly connected to a top of the end (12) at the upper end; strong magnets (11) are fixedly connected to the two ends (12) of the light stick (3) respectively; and the two strong magnets (11) are magnetically connected to the main hinge seat (1) and the auxiliary hinge seat (4) respectively.

5. The tent frame with the supporting and limiting structure according to claim 1, wherein the connection parts between the four connecting rods (6) and the top rods (2) are fixedly connected to a supporting seat (10) for supporting bottoms of the top rods (2), and each of the four top rods (2) is fixedly connected to a limiting rod (9) for limiting the limiting supporting rod (5).

6. The tent skeleton with the supporting and limiting structure according to claim 1, wherein a diamond-shaped telescopic frame (8) for improving stability of a bottom of the skeleton is hinged between the upper connecting seat (18) and the lower connecting seat (22) on the supporting rod (7) and the upper connecting seat (18) and the lower connecting seat (22) on the adjacent supporting rod (7); and the diamond-shaped telescopic frame (8) is composed of a plurality of horizontal cross rods hingedly connected.

7. The tent skeleton with the supporting and limiting structure according to claim 1, wherein a limiting sleeve (21) located between the upper connecting seat (18) and the lower connecting seat (22) is sleeved on each of the four supporting rods (7), and the bottom of each of the four supporting rods (7) is fixedly connected to a fixing seat (20).

* * * * *